US009431746B2

(12) United States Patent
Wu et al.

(10) Patent No.: US 9,431,746 B2
(45) Date of Patent: Aug. 30, 2016

(54) USB CONNECTOR ASSEMBLY

(71) Applicant: FOXCONN INTERCONNECT TECHNOLOGY LIMITED, Grand Cayman (KY)

(72) Inventors: Zhuang-Zhi Wu, Kunshan (CN); Chien-Hsun Huang, New Taipei (TW); Xiao-Li Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/869,985

(22) Filed: Sep. 29, 2015

(65) Prior Publication Data

US 2016/0093970 A1 Mar. 31, 2016

(30) Foreign Application Priority Data

Sep. 30, 2014 (CN) ..... 2014 2 0571121 U

(51) Int. Cl.

| | |
|---|---|
| ***H01R 13/658*** | (2011.01) |
| ***H01R 13/443*** | (2006.01) |
| ***H01R 13/6581*** | (2011.01) |
| ***H01R 13/66*** | (2006.01) |

(52) U.S. Cl.

CPC ..... *H01R 13/443* (2013.01); *H01R 13/6581* (2013.01); *H01R 13/665* (2013.01)

(58) Field of Classification Search

CPC ..... H01R 23/7073; H01R 23/725; H01R 23/6873; H01R 13/658; H01R 13/65802

USPC ..... 439/660, 607.4, 0.43, 0.51, 0.54

See application file for complete search history.

(56) References Cited

U.S. PATENT DOCUMENTS

| | | | | |
|---|---|---|---|---|
| 8,366,490 | B2 * | 2/2013 | Wu | H01R 13/502 439/660 |
| 8,366,491 | B2 * | 2/2013 | Wu | H01R 12/55 439/660 |
| 8,403,706 | B2 * | 3/2013 | Wu | H01R 13/506 439/607.46 |
| 8,430,693 | B2 * | 4/2013 | Wu | H01R 13/6658 439/607.5 |
| 8,461,465 | B2 | 6/2013 | Golko et al. | |
| 8,686,600 | B2 | 4/2014 | Terlizzi et al. | |
| 2012/0071022 | A1 * | 3/2012 | Su | H01R 13/6658 439/449 |

FOREIGN PATENT DOCUMENTS

| | | |
|---|---|---|
| CN | 203193000 | 9/2013 |

* cited by examiner

*Primary Examiner* — Hien Vu

(74) *Attorney, Agent, or Firm* — Wei Te Chung; Ming Chieh Chang

(57) ABSTRACT

A USB (Universal Serial Bus) plug connector includes an insulative housing, a number of terminals retained in the insulative housing, and a protector enclosing the insulative housing. The housing defines an upper surface, a bottom surface, a pair of side surfaces, and a front surface. The protector defines a front wall, a pair of side walls extending backwardly from two edges of the front wall, and a number of affixed portions extending backwardly from the front wall and located between the two side walls. The affixed portions are received in the insulative housing. The front wall of the protector encloses the front surface of the insulative housing and the side walls of the protector respectively enclose the side surfaces of the insulative housing to prevent the insulative housing from physically contacting with a mating USB receptacle connector.

13 Claims, 7 Drawing Sheets

USB CONNECTOR ASSEMBLY

BACKGROUND OF THE INVENTION

1. Field of the Invention

The present invention relates generally to a USB (Universal Serial Bus) plug connector, and more particularly to a USB connector assembly that protects its plug housing from damage during mating.

2. Description of Related Arts

Chinese Pat. No. CN203193000, issued on Sep. 11, 2013, discloses a reversible plug connector for inserting into a mating receptacle connector in two orientations. The plug connector has an insulative body, a plurality of terminals retained in the insulative body, a printed circuit board connected with the terminals, a shell attached to the insulative body, and an insulative housing insert-molded with the shell. The housing has a tongue portion exposed from the shell to mate with the receptacle connector. After repeated insertion and withdrawal in use between the plug connector and the receptacle connector, the tongue portion is apt to damage.

A USB plug connector avoiding damage to its housing in use is desired.

SUMMARY OF THE INVENTION

Accordingly, an object of the present invention is to provide a USB plug connector avoiding damage to its housing in use.

To achieve the above object, a USB (Universal Serial Bus) plug connector comprises: an insulative housing defining an upper surface, a bottom surface, a pair of side surface, and a front surface; a plurality of terminals retained in the insulative housing; and a protector enclosing the insulative housing, the protector defining a front wall, a pair of side walls extending backwardly from two edges of the front wall, and a plurality of affixed portions extending backwardly from the front wall and located between the two side walls, the affixed portions received in the insulative housing, the front wall of the protector enclosing the front surface of the insulative housing, the side walls of the protector respectively enclosing the side surfaces of the insulative housing, whereby the protector prevents the insulative housing from physically contacting with a mating USB receptacle connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
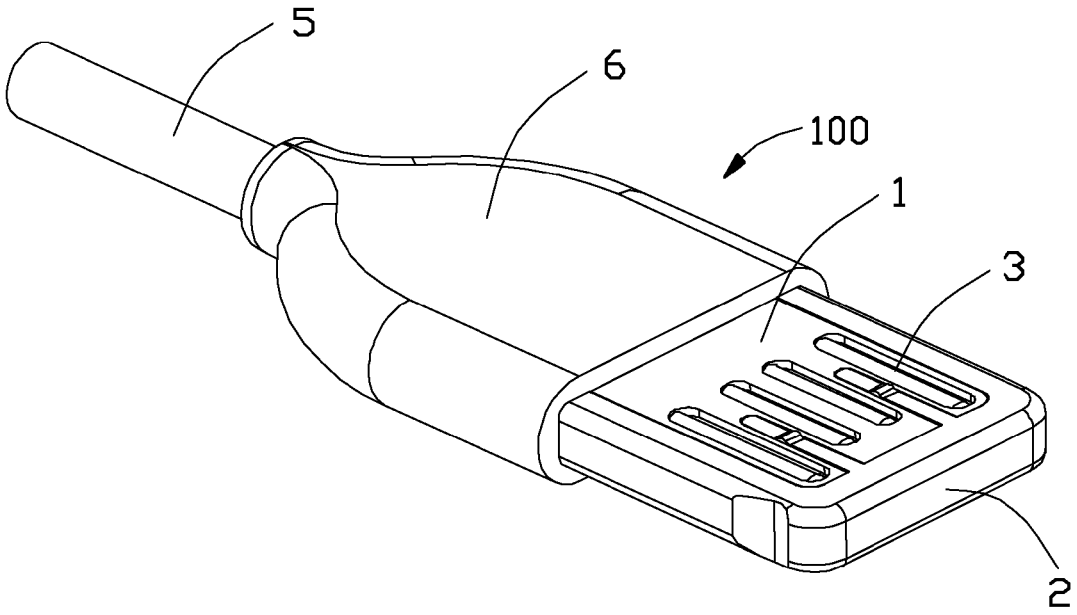
FIG. 1 is a perspective, assembled view of a USB plug connector.

Reference will now be made in detail to the preferred embodiment of the present invention.

Referring to FIGS. 1 to 5, a USB (Universal Serial Bus) plug connector 100 of the present invention, used for engaging with a USB receptacle connector 200, includes an insulative housing 1, a protector 2 at least part of which is attached to the insulative housing 1, a plurality of terminals 3 retained in the insulative housing 1, a printed circuit board 4 soldered with the terminals 3 and the insulative housing 1, a cable 5 soldered with the printed circuit board 4 and the terminals 3, and an insulative cover 6 partly covering the insulative housing 1 and the printed circuit board 4. Defining a mating direction, a transverse direction is perpendicular to the mating direction, and a vertical direction is orthogonal to the mating direction and the transverse direction.

Figure 2:
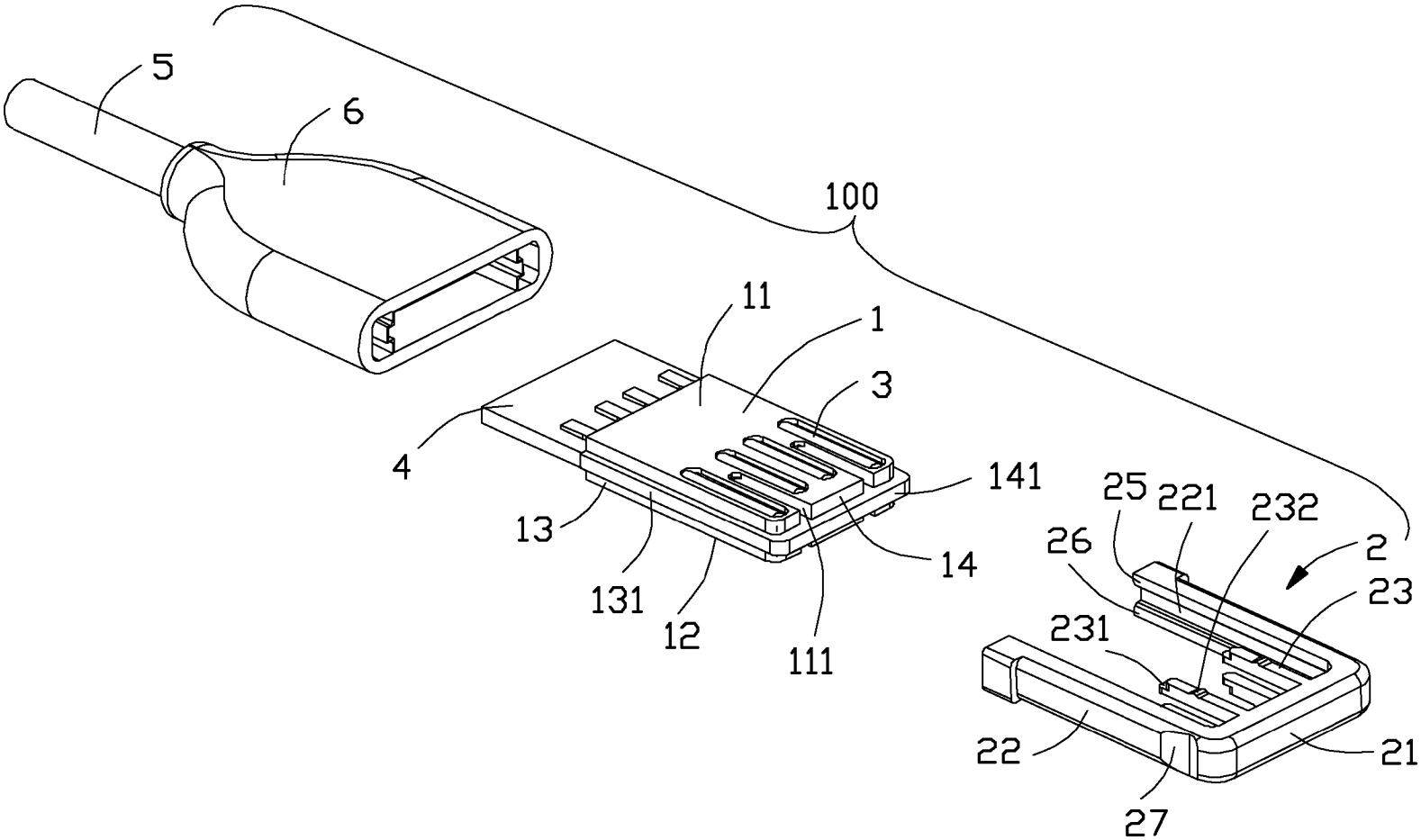
FIG. 2 is a perspective, exploded view of the USB plug connector of FIG. 1.
Figure 3:
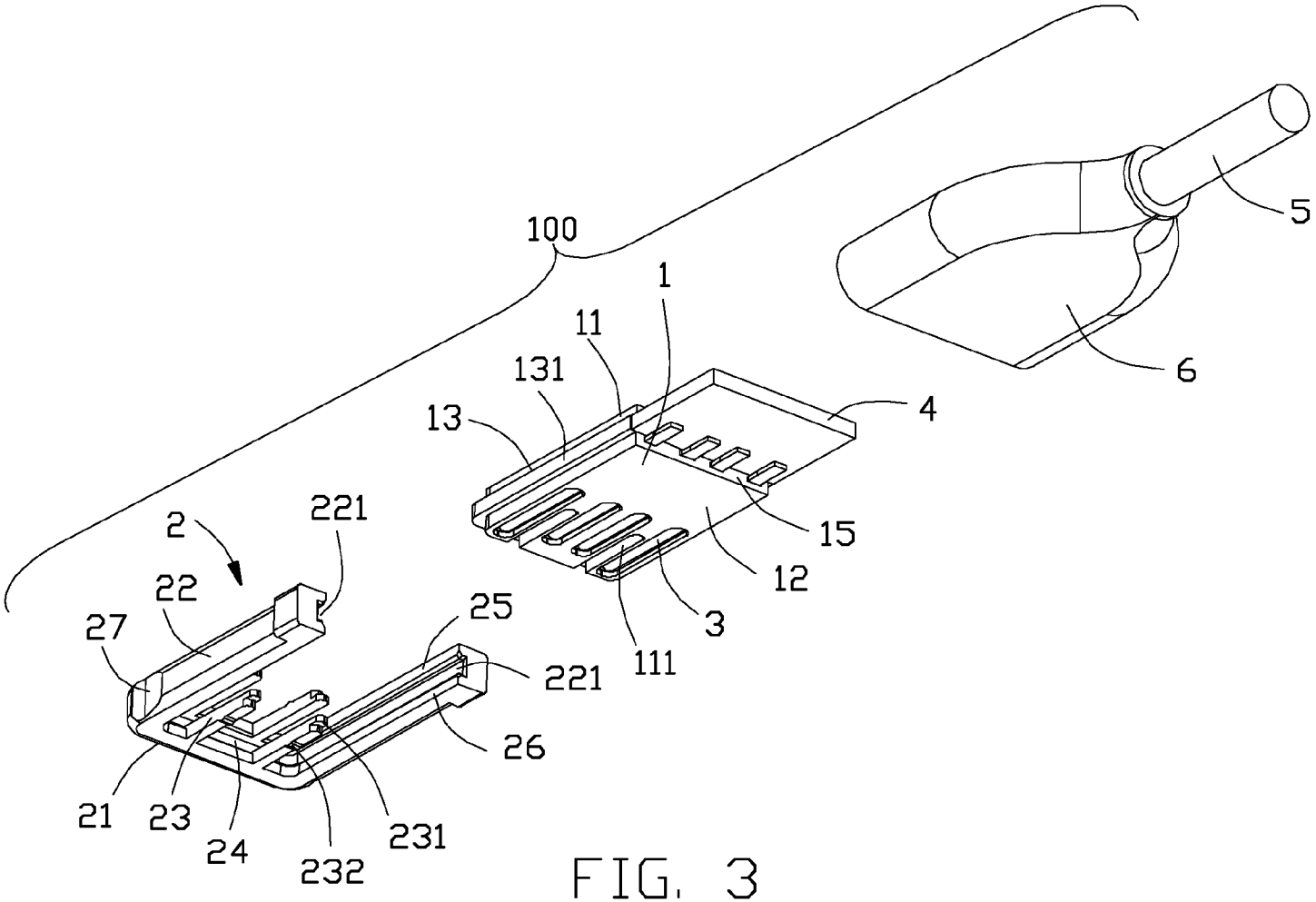
FIG. 3 is similar to FIG. 2, but taken from a different view.

Referring to FIGS. 2 and 3, the insulative housing 1, shaped as a panel, defines an upper surface 11, a bottom surface 12 faced to the upper surface 11, a pair of side surfaces 13 connected with the upper surface 11 and the bottom surface 12, a front surface 14, and a rear surface 15 facing the front surface 14. The upper surface 11 and the bottom surface 12 respectively define a pair of orienting slots 111 projecting downwardly and a plurality of receiving slots 112 projecting backwardly. Each orienting slot 111 extends rearward from the front surface 14 and is in fluid communication with the receiving slot 112. The front surface 14 has a first slider 141 in the middle thereof and each side surface 13 has a first slider 131.

The protector 2 defines a number of frames. The frames include a front wall 21 extending transversely, a pair of side walls 22 extending along the mating direction from two edges of the front wall 21 and four affixed portions 23 extending along the mating direction and poisoned between the two side walls 22. Each affixed portion 23 has a stepped portion 231 at a free end thereof and a plurality of projections 232 at an upper surface and a bottom surface thereof The front wall 21 has a first sliding groove 24 in an inner surface thereof. The four affixed portions 23 are arranged in two rows along the vertical direction and the affixed portions 23 in one row face those in the other row. Each side wall 22 of the protector 2 has a top edge 25 and a bottom edge 26 extending inwardly and a depression 27 located at the outer surface. The top edge 25 and the bottom edge 26 in the same side wall 22 define a second sliding groove 221 therebetween.

Figure 4:
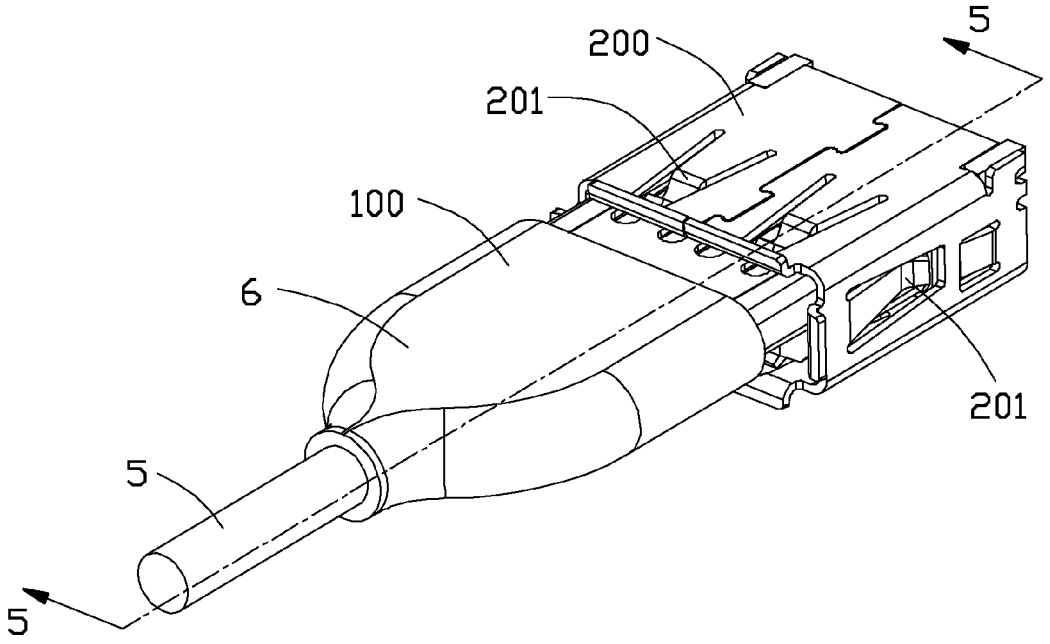
FIG. 4 is a perspective, assembly view of the electrical connector and a receptacle connector.
Figure 5:
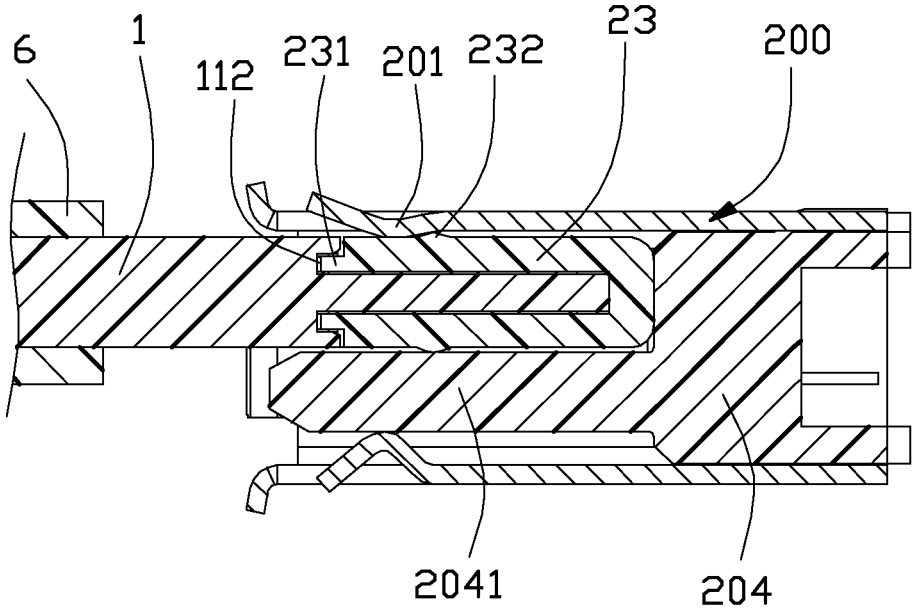
FIG. 5 is a cross-sectional view of FIG. 4 when taken along line 5-5.
Figure 6:
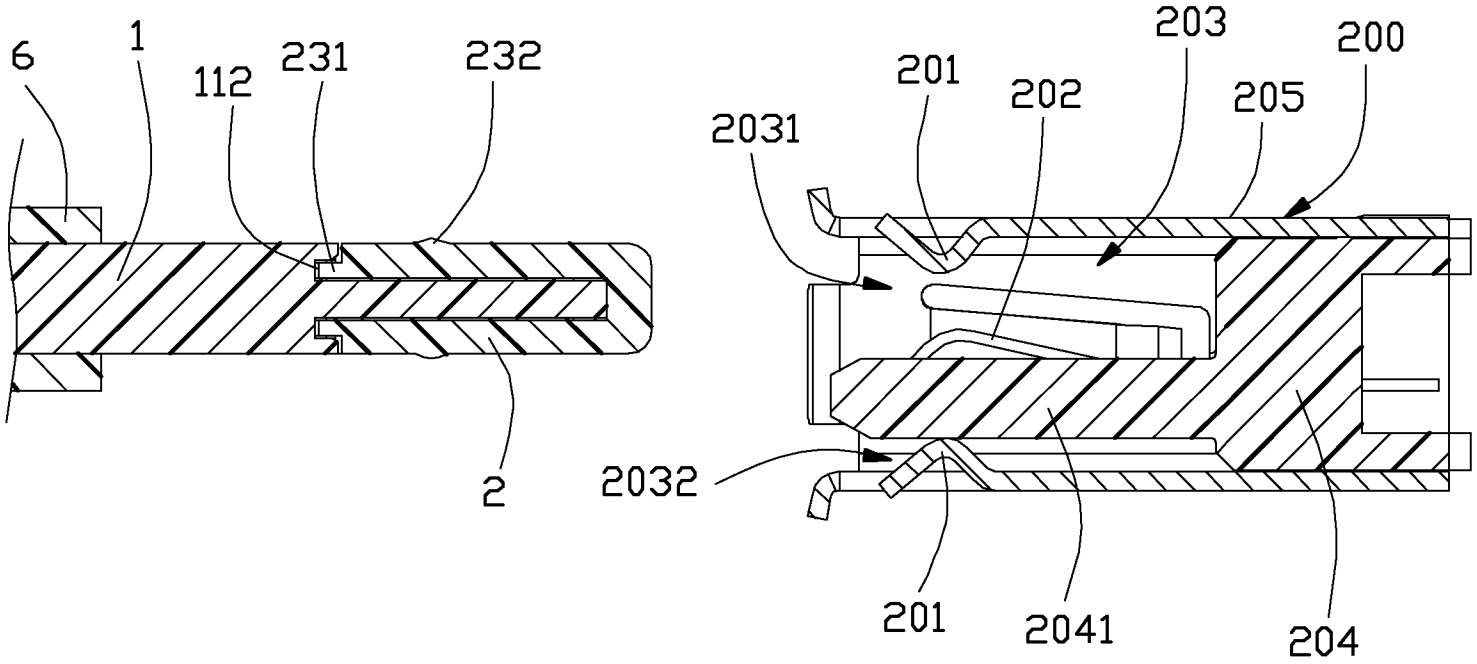
FIG. 6 is a cross-sectional view of the receptacle connector and the plug connector of FIG. 4 in an unmated manner.
Figure 7:
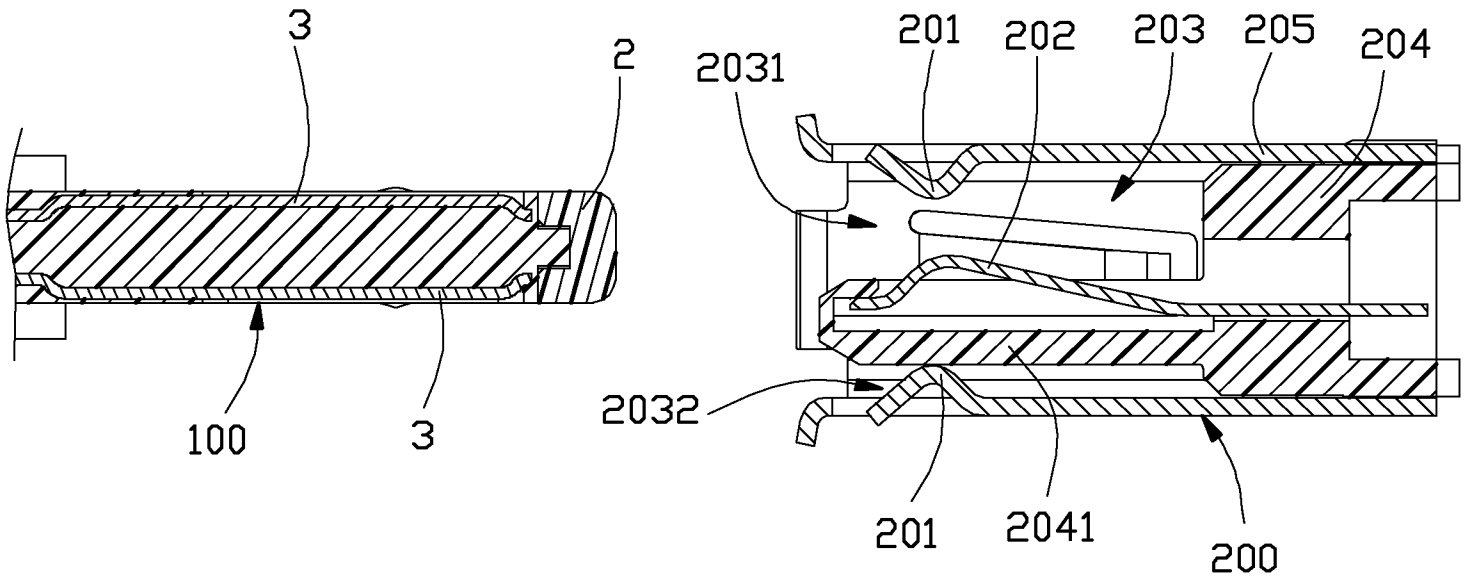
FIG. 7 is another cross-sectional view of the receptacle connector and the plug connector of FIG. 4 in an unmated manner.

Referring to FIGS. 4 and 5, when the protector 2 is assembled to the insulative housing 1, the affixed portions 23 are received in the orienting slots and the stepped portions 231 of the affixed portions 23 are received in the receiving slots 112. The second sliders 131 of the insulative housing 1 are received in the second sliding grooves 221 of the protector 2. The first sliders 141 of the insulative housing 1 are received in the first sliding grooves 24 of the protector 2. The upper surface 11 and the bottom surface 12 of the insulative housing 1 are exposed to the protector 2, the upper surface 11 is located at the same plane with the top edge 25, and the bottom surface 12 is located at the same plane with the bottom edge 26, so that the USB plug connector 100 electrically and physically mate to a corresponding USB receptacle connector 200, irrespective of whether the first or second side is oriented to mate with the contacts of the USB receptacle connector 200.

Referring to FIGS. 4-7, the USB receptacle connector 200 has a metallic shield 205 essentially composed of an upper board, a bottom board, and a pair of side boards commonly defining a mating cavity 203. The USB receptacle connector 200 has a plurality of contacts 202 in the mating cavity 203, and latches 201 formed on the upper/bottom board and the side boards. When the USB plug connector 100 is inserted into the USB receptacle connector 200, the contacts 202 of the USB receptacle connector 200 are electrically contacted with the terminals 3 of the upper surface 11 and the bottom surface 12. The latches 201 on the upper board of the USB receptacle connector 200 are interfered with the projection 232 and the latches 201 in the side boards of the USB receptacle connector 200 are interfered with the depression 27 of the protector 2 for a stable mating. It is noted that in this embodiment the receptacle connector 200 includes an insulating housing 204 enclosed within the metallic shield 205, and a mating tongue 2041 of the housing extends forwardly in the mating cavity 203 wherein the mating tongue 2041 is offset in the mating cavity 203 in the vertical direction to form a large space 2031 and a small space 2032 beside the opposite surfaces of the mating tongue 2041 and the contacts 202 face the large space 2031. The latch 201 on the upper board is not aligned with any contacts in the vertical direction but in an offset manner in the transverse direction so during mating the latch 201 on the upper board only engages the corresponding projection 232 while being spaced from the adjacent terminals 3 in the transverse direction for avoiding shorting.

In this embodiment, the terminals 3 are respectively located at the upper surface 11 and the bottom surface 12. The insulative housing 1 is integrated with the protector 2 by means of the second slider 131 sliding into the first sliding groove 24 so that the insulative housing 1 is firmly cooperated with the protector 2. Therefore, it is easy for the insulative housing 1 and the terminals 3 to orientate with respect to the protector 2 through a much more convenient manufacture. The affixed portions 23 are received in the orienting slots 22 and the stepped portions 231 are received in the receiving slots 112 to prevent the affixed portions 23 from warping in use. The terminals 3 are soldered to the printed circuit board 4 and the cable 5 is soldered to the printed circuit board 4 to electrically contact with the terminals 3. The insulative shell 6 is attached to the protector 2 and partly covers the protector 2 and the insulative housing 1. The terminals 3 on the upper surface 11 and the bottom surface 12 are positioned on the insulative housing 1 to have a 180-degree symmetry such that the USB plug connector 100 can be inserted and operatively coupled to a corresponding USB receptacle connector 200 in either of two orientations. The USB plug connector 100 is protected by the protector 2 enclosing the insulative housing 1.

In other embodiment, the manufacture method is that the terminals 3 are soldered to the printed circuit board 4 at first, and then, the terminals 3, the printed circuit board 4, and the protector 2 are received in a mould to insert-mold with the insulative housing 1.

In other embodiment, the second sliding groove 221 is defined in two sides of the insulative housing 1 and the second slider 131 is defined in the two side walls 22 of the protector 2.

Notably, as shown in FIG. 2 of U.S. Pat. No. 7,717,717, the traditional USB plug connector includes a metallic shell enclosing the insulative housing circumferentially and snugly received within the metallic shield of the receptacle connector. In other words, in the traditional mated connectors, the mating tongue of the receptacle connector is fully circumferentially surrounded in a receiving space formed between the metallic shell and the mating plate of the plug connector. Differently, in the instant invention, no circumferential metallic shell is provided but only the housing 1 with the protector 2 is received in the mating cavity of the receptacle connector 200. In other words, the mating tongue of the receptacle connector 200 is not enclosed within the plug connector. Therefore, in the preferred embodiment, the deflectable latch 201 on the bottom board may upwardly press against a bottom face of the mating tongue for reinforcing the mating tongue to resist the possible downward applied forces. Anyhow, the receptacle connector 200 is still adapted to be mated with the traditional plug connector wherein the latch 201 on the bottom board is downwardly deflectable when the metallic shell of the traditional plug connector is mated to occupy the space between the mating tongue and the bottom board of the metallic shield of the receptacle connector 200.

On the other hand, in the instant invention the dimension of the plug connector 100 including the housing 1 and the protector 2, should be compliant with a large space 2031 formed between the mating tongue and the metallic shield of the receptacle connector 200 as shown in FIG. 5 in both the mutually perpendicular vertical direction and the transverse direction. Thus, during mating the plug connector 100 is only occupies the large space 1031 while leaving the small space 2031 empty. One feature of the invention is to provide availability of coupling the plug connector 100 into the receptacle connector 200 in a flippable way without the specific orientation. Understandably, because the traditional USB plug connector and receptacle connector may not allow the flippable mating way, the aforementioned U.S. Pat. No. 7,717,717 uses a thinner double sided mating plate in the existing metallic shell of the plug connector for the flippable mating, thus jeopardizing the structural strength of the mating plate of the plug connector. In the instant invention, the traditional metallic shell of the plug connector is removed but being replaced with the protector. This arrangement may avoid the strength defects of the plug connector derived from the thinned mating plate thereof disclosed in the aforementioned U.S. Pat. No. 7,717,717. One feature of the invention is to have the contacting/exterior surface of the terminal 3 is inwardly recessed, in the vertical direction, from the exterior surface of the housing 1, i.e., the upper surface 11 and the bottom surface 12, with a tiny gap so as to avoid any improper contact between the terminals 3 and the upper board of the shield 205 during mating.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A USB (Universal Serial Bus) plug connector comprising: an insulative housing defining an upper surface, a bottom surface, a pair of side surfaces, and a front surface; a plurality of terminals retained in the insulative housing; and a protector enclosing the insulative housing, the protector defining a front wall, a pair of side walls extending backwardly from two edges of the front wall, and a plurality of affixed portions extending backwardly from the front wall and located between the two side walls, the affixed portions received in the insulative housing, the front wall of the protector enclosing the front surface of the insulative housing and the side walls of the protector respectively enclosing the side surfaces of the insulative housing to prevent the insulative housing from physically contacting with a mating USB receptacle connector;

wherein each affixed portion has a projection located at an outer surface thereof;

wherein the insulative housing has a plurality of orienting slots receiving the affixed portions;

wherein each affixed portion has a stepped portion at a free end thereof, each stepped portion extends into a corresponding orienting slot, and the free end of each stepped portion is embedded in the insulative housing; and wherein the affixed portions are divided into two rows, the terminals include two outermost contacts at two lateral edges of the insulative housing, and the affixed portions are located inwardly of the outermost contacts.

2. The USB plug connector as claimed in claim 1, wherein the affixed portions extend along an upper edge and a lower edge of the front wall.

3. The USB plug connector as claimed in claim 2, wherein the terminals are disposed in both the upper surface and the bottom surface of the insulative housing to have 180 degree symmetry, and the orienting slots are respectively exposed to the upper surface and the bottom surface.

4. The USB plug connector as claimed in claim 1, wherein the insulative housing has a first slider at an edge, and the protector has a first sliding groove at an inner surface of a corresponding side to receive the first slider.

5. A USB (Universal Serial Bus) connector assembly comprising: a USB receptacle connector having a plurality of latches extending inwardly; and a USB plug connector for mating with the USB receptacle connector, the USB plug connector comprising: an insulative housing defining an upper surface, a bottom surface, a pair of side surfaces, and a front surface; a plurality of terminals retained in the insulative housing; and a protector enclosing the insulative housing, the protector defining a front wall, a pair of side walls extending backwardly the front wall, and a plurality of affixed portions extending backwardly from the front wall and located between the two side walls, the affixed portions received in the insulative housing, the front wall of the protector enclosing the front surface of the insulative housing, the side walls of the protector respectively enclosing the side surfaces of the insulative housing, the affixed portions resisted against by the latches of the USB receptacle connector when the USB plug connector is coupled to the USB receptacle connector;

wherein the insulative housing has a plurality of orienting slots receiving the affixed portions; and wherein each affixed portion has a stepped portion at a free end thereof, each stepped portion extends into a corresponding orienting slot, and a free end of each stepped portion is embedded in the insulative housing.

6. The USB connector assembly as claimed in claim 5, wherein each affixed portion has a projection located at an outer surface thereof, and the latches of the USB receptacle connector are resisted against by the projections.

7. A USB (Universal Serial Bus) connector assembly comprising: a receptacle connector including a metallic shield defining a mating cavity, an insulating housing enclosed in the metallic shield and forming a mating tongue extending forwardly in the mating cavity, said mating tongue located in the mating cavity in an offset manner in a vertical direction so as to form a large space and a small space by opposite faces of the mating tongue in said mating cavity, respectively, a plurality of contacts disposed in the housing and exposed upon the face which intimately confronts the large space; a plug connector including: an insulative housing in form of a plate defining opposite surfaces in the vertical direction; a plurality of terminals on said two opposite surfaces, the terminals on one surface defining same electrical characters with those on the other surface so as to allow said plug to be used in a flippable way; a metallic protector enclosing at least a partial periphery of said housing; wherein during mating, the plug connector only occupies the large space while having the small space remain empty; wherein the latch facing the large space in the vertical direction, is not aligned with any contact in the vertical direction but with an offset in a transverse direction perpendicular to said vertical direction;

wherein the protector encloses a front edge, and two side edges of the insulative housing which are opposite to each other in said transverse direction;

wherein said protector further includes an affixed portion extending along a front-to-back direction perpendicular to said vertical direction and has a stepped portion at a free end thereof, the stepped portion piercing into the insulative housing while spaced from the neighboring terminals in said transverse direction; and wherein a projection is formed upon the affixed portion so as to be engaged with a corresponding deflectable latch formed on the metallic shield of the receptacle connector during mating.

8. The USB connector assembly as claimed in claim 7, wherein the metallic shield forms a plurality of deflectable latches, and the protector forms corresponding projections or depressions to be coupled thereto so as to retain the mated plug connector and receptacle connector.

9. The USB connector assembly as claimed in claim 8, wherein the projections are located around said opposite surfaces of the insulative housing.

10. The USB connector assembly as claimed in claim 8, wherein the depressions are formed around two opposite lateral sides of the protector which cover corresponding side edges of the insulative housing.

11. The USB connector assembly as claimed in claim 7, wherein during mating the deflectable latch is aligned with the corresponding projection in the vertical direction and is offset from the terminals in the transverse direction.

12. The USB connector assembly as claimed in claim 7, wherein a contacting surface of the terminal is inwardly recessed, in the vertical direction, from a corresponding exterior surface of either the housing or the protector with a tiny gap for not contacting the metallic shield of the receptacle connector during mating.

13. The USB connector assembly as claimed in claim 7, wherein said protector forms a sliding groove to receive a corresponding printed circuit board which is sandwiched between the insulative housing.

* * * * *